US012089724B2

(12) United States Patent
Wienberg

(10) Patent No.: US 12,089,724 B2
(45) Date of Patent: Sep. 17, 2024

(54) COMBINED RUCKSACK AND A SHOULDER BAG

(71) Applicant: Marlin Group ApS, Aarhus (DK)

(72) Inventor: Martin Wienberg, Højbjerg (DK)

(73) Assignee: Marlin Group ApS, Aarthus (DK)

( * ) Notice: Subject to any disclaimer, the term of this patent is extended or adjusted under 35 U.S.C. 154(b) by 117 days.

(21) Appl. No.: 17/925,746

(22) PCT Filed: May 19, 2021

(86) PCT No.: PCT/EP2021/063331
§ 371 (c)(1),
(2) Date: Nov. 16, 2022

(87) PCT Pub. No.: WO2021/234021
PCT Pub. Date: Nov. 25, 2021

(65) Prior Publication Data

US 2023/0180919 A1 Jun. 15, 2023

(30) Foreign Application Priority Data

May 19, 2020 (DK) ..... PA 202070327

(51) Int. Cl.
*A45F 3/04* (2006.01)
*A45F 3/02* (2006.01)
*A45F 4/02* (2006.01)

(52) U.S. Cl.
CPC ..... *A45F 4/02* (2013.01); *A45F 3/04* (2013.01); *A45F 3/02* (2013.01)

(58) Field of Classification Search
CPC ..... A45F 3/04; A45F 3/02
(Continued)

(56) References Cited

U.S. PATENT DOCUMENTS 2,210,351 A * 8/1940 Westendorf ..... A45C 3/00 383/18
2,902,195 A * 9/1959 Marshall ..... A01K 97/20 224/608

(Continued)

FOREIGN PATENT DOCUMENTS

DE 7516252 U 10/1975
DE 202012010159 U1 12/2012

(Continued)

*Primary Examiner* — Justin M Larson
(74) *Attorney, Agent, or Firm* — DINSMORE & SHOHL LLP

(57) ABSTRACT

A rucksack and shoulder bag has a storage bin with two opposite sides; a single continuous strap encircling the bin, the strap ends being attached to the storage bin on opposite sides at predefined attachment points. At least four loops are attached to the storage bin. The strap is led through each of the loops such that the strap may slide through the loops. The attachment points and loops are distributed such that the bag has at least two configurations: a first configuration wherein one of the attachment points and three of the loops define carrying points for two shoulder straps as a rucksack, and a second configuration wherein the strap extends diagonally across a top part of the storage bin between two of the loops located on the opposite sides, wherein the bag may be carried with the strap extending diagonally across the top part as a shoulder bag.

20 Claims, 8 Drawing Sheets

(58) Field of Classification Search
USPC ..... 224/578, 579
See application file for complete search history.

(56) References Cited

U.S. PATENT DOCUMENTS 3,019,952 A * 2/1962 Brewster ..... A45C 3/00 294/142
4,273,274 A 6/1981 Freistadt
5,415,332 A * 5/1995 Kliot ..... A45F 3/02 150/108
5,431,317 A 7/1995 Kliot
5,927,581 A * 7/1999 Reddy ..... A45F 3/04 224/655
6,220,493 B1 * 4/2001 Iijima ..... A45F 3/02 224/153
6,286,461 B1 * 9/2001 Martz ..... A01K 1/0254 119/497
7,160,028 B1 * 1/2007 Linday ..... A45C 9/00 150/108
8,092,087 B2 * 1/2012 Simhony ..... A45F 3/14 150/108
8,231,037 B2 * 7/2012 Sacks ..... A45F 3/14 224/153
8,657,169 B2 * 2/2014 Demskey ..... A45F 3/02 224/628
8,746,523 B1 * 6/2014 Woolley ..... A45C 13/30 224/578
D902,598 S * 11/2020 Chung ..... A45C 13/30 D3/327

FOREIGN PATENT DOCUMENTS

DE 10055165 A1 4/2013
DE 102011116293 A1 4/2013
WO 2015147759 A1 1/2015
WO 2015150878 A1 8/2015

* cited by examiner

COMBINED RUCKSACK AND A SHOULDER BAG

CROSS-REFERENCE TO RELATED APPLICATIONS

This application is the U.S. National Stage of PCT/EP2021/063331 filed on May 19, 2021, which claims priority to Denmark Patent Application PA 202070327 filed on May 19, 2020, the entire content of both are incorporated herein by reference in their entirety.

FIELD OF THE INVENTION

The present disclosure relates to a bag, which can transform easily from a rucksack to a shoulder bag and vice versa.

BACKGROUND OF THE INVENTION

Wearing a shoulder bag obstructs certain movements or exercises, for example the exercise of riding a bike. When biking, the shoulder bag may slide down the back of the user and may end up hanging down from the neck and arm obstructing the movement of the legs. For riding a bike, it is much more convenient to carry a rucksack rather than a shoulder bag. However, wearing a rucksack may be associated with another image than the user want to achieve for example it may look less professional than a shoulder bag as it may be associated with schoolchildren or hikers rather than professional business people. For example, if someone is attending a professional business meeting, it may look more professional to bring a shoulder bag to a meeting, rather than a rucksack. Also, fashionable teens or other groups, which may be concerned about their appearance, may be reluctant to wear a rucksack.

A lot of people, especially in the big cities, ride their bike to work every day, as it may be the fastest, most enjoyable or simply the easiest way to get to work. Also people who work in a job in which their appearance matters may transport themselves to and from work by riding a bike. Hence, there may be a trade-off between appearance and functionality of the bag one chooses to use when riding a bike to work. Someone may choose comfort and safety of their bike ride over ones appearance at the job and choose to wear a rucksack even though one may prefer bringing a shoulder bag to work. Other people may choose to ride their bike uncomfortably and possibly dangerously with a shoulder bag over their shoulder, in order to be able to bring a shoulder bag, such as a computer bag, to work.

As an alternative, various convertible bags exists in which it is possible to change the same bag from a rucksack to a shoulder bag and vice versa. However, the transformation often takes a considerable amount of time given how often the user may need to make the transformation. In addition, the transformation is often necessary in relation to transport when the user may be in a hurry. If one is late for a meeting it is inconvenient to spend a long time pulling multiple places in one or more straps or to unhook, move and fasten hooks, or similar, before the bag transformation is complete and the user is ready to go. In addition, many such convertible bags are uncomfortable to wear, as the position of the strap in the rucksack mode, the shoulder bag mode or even in both modes, is not ideal for its purpose. Hence, the ability to transform between the two bag types may compromise the primary function of the bag.

WO2015150878 discloses a transformable rucksack/shoulder bag with one strap. Both ends of the strap is attached on one side of the bag. In both rucksack configuration and shoulder bag configuration the strap only in contact with the same, one side of the bag.

DE10055165 discloses a transformable rucksack/shoulder bag in which both ends of a strap is attached on one side of the bag. In the shoulder bag configuration, the strap is led straight across the top-side of the bag.

WO2015147759 discloses a transformable rucksack/shoulder bag comprising a strap and four attachment members along the circumference of the bag, allowing the transformation by the number of attachment members used.

SUMMARY OF THE INVENTION

Considering the prior art as described above, it is an object of the present disclosure to solve the need of a multipurpose bag with an easy, mind-free transformation between the different bag types.

The object can be achieved by the presently disclosed bag for use as rucksack and shoulder bag. Preferably, the bag comprises a storage bin having two opposite sides, and a single continuous strap encircling the storage bin. The two strap ends of the single strap may be attached to each their opposite side, most preferably in the upper part of the sides. According to one embodiment, the single strap has at least six slidable engagements with the bin at six different positions of said opposite sides. Preferably, the strap ends' attachments and the strap's slidable engagements are distributed such that the strap has at least two configurations: a first configuration wherein one of the strap end attachments and three of the slidable engagements on one opposite side define four carrying positions of a rucksack, and a second configuration wherein the strap extends diagonally across a top part of the storage bin between two of said slidable engagements at the opposite sides, and configured for shoulder bag use by carrying the bag in the diagonal part of the strap.

Thus, it is possible to transform a rucksack to a shoulder bag by a single, simple movement, such as pulling the encircling strap at the intended carrying position(s). I.e. when transforming from rucksack to shoulder bag the diagonal part of the strap is pulled, and when transforming from shoulder bag to rucksack the strap is pulled in the side positions that are carried over the shoulders of the user.

The slidable engagements of the presently disclosed bag may function as to lead the strap around the bag in a specific manner. The strap may be led through the slidable engagements in order to support a given configuration of the strap. In addition, the slidable engagements may allow the strap to move freely or almost freely, for example with some amount of friction, through these slidable engagements. If the bag comprises a strap which is longer than necessary to tightly encircle the bag in the desired configuration, the slidable engagements may allow that the access part of the strap can be moved to a different part of the strap configuration encircling the bag. In this manner access length of the strap in one part of the strap configuration may result in the strap being able to be used as a shoulder bag strap and by leading the access strap via the slidable engagements to other parts of the strap configuration, the access strap length may be used as straps for a rucksack. The slidable engagements may be provided in the form of loops.

According to a preferred embodiment, the bag comprises a storage bin having two opposite sides; a single continuous strap encircling the storage bin, wherein the ends of the strap are attached to the storage bin on each of the opposite sides at predefined attachment points; and at least four loops attached to the storage bin, wherein the strap is led through each of said loops such that the strap may slide through the loops. In the preferred embodiment, the attachment points and the four loops are distributed such that the bag has at least two configurations: a first configuration wherein one of the attachment points and three of the loops define carrying points for two shoulder straps such that the bag is configured for use as a rucksack, and a second configuration wherein the strap extends diagonally across a top part of the storage bin between two of the loops located on the opposite sides, wherein the bag may be carried in the strap extending diagonally across the top part, such that the bag is configured for use as a shoulder bag.

Carrying points should be understood as termination points of the shoulder strap(s), said shoulder strap(s) being defined by one or more strap sections in the two configurations of the bag, once the encircling strap is pulled into the desired configuration. As an example, the first strap section (14) and the second strap section (18) may define two shoulder straps of the bag. In the rucksack configuration, one of said carrying points is preferably a fixed attachment point and the remaining three carrying points are defined by the loops.

DESCRIPTION OF THE DRAWINGS

The present disclosure is further detailed below with the help of the accompanying figures. It will be appreciated by the people skilled in the art that the same feature or component of the device are referred with the same reference numeral in different figures. A list of the reference numbers can be found at the end of the detailed description section.

DETAILED DESCRIPTION OF THE INVENTION

The presently disclosed bag may be worn as a rucksack, as shown in FIG. 1A or as a shoulder bag as shown in FIG. 1B. Preferably, it is possible to transform the bag between the rucksack mode and the shoulder bag mode by rearranging the strap of the bag, more preferably this is possible by one or more easy pulls in strategic places on the strap of the bag. An example of the transformation mechanism between the two is illustrated in FIG. 2.

Figure 3:
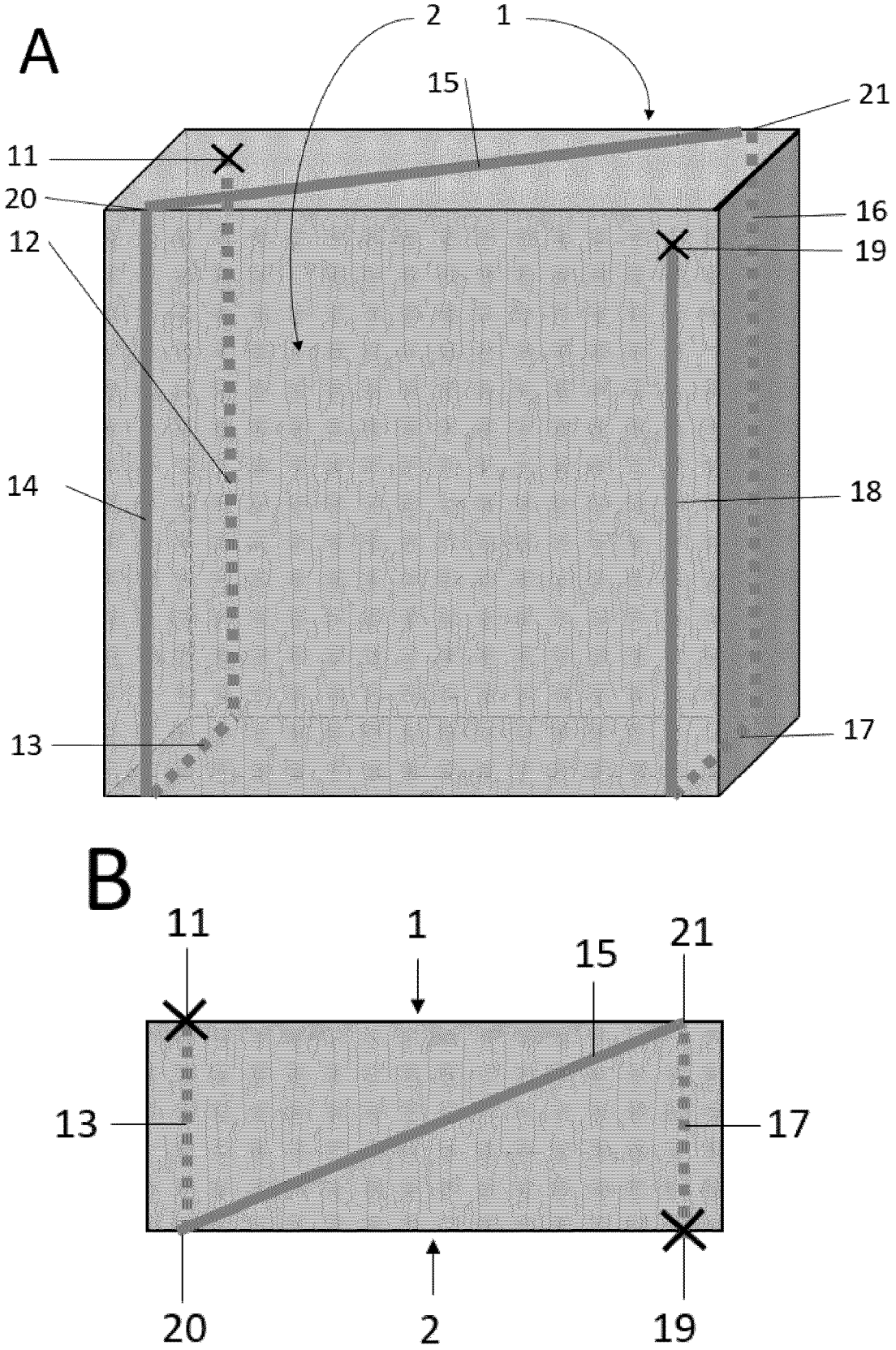
FIG. 3 shows a sketch of one embodiment of the strap configuration of the presently disclosed bag.

The strap and slidable engagements of the presently disclosed bag are preferably distributed such that the opposite sides are 180 degrees rotation symmetric. One example of such a distribution is illustrated in FIG. 3. In FIG. 3 the opposite sides of the bin 1 and 2 are equivalent upon 180 degrees rotation around a vertical axis centred in the bag, strap sections 14 and 18 are equivalent to 12 and 16 upon the 180 degrees rotation. The strap attachments 11 and 19 are equivalent upon the 180 degrees rotation. The 180 degrees rotational symmetry corresponds to a 2-fold rotational symmetry with respect to a central vertical axis running parallel with the two opposite sides. This ensures that any of the opposite sides of the storage bin can face the back of a user in the rucksack configuration.

The strap used for the presently disclosed bag may be a rope but more preferred a webbing. Webbing is a strong fabric woven as a flat strip or tube of varying width and fibres. Webbing may be made of hemp, cotton or linen, but preferred here is synthetic fibres, such as nylon, polypropylene or polyester, most preferred is webbing made from recycled plastics. Webbing is both light and strong, with high breaking strength. For the presently disclosed bag flat webbing is preferred over tubular webbing as it is more comfortable when wearing. The width of the strap may be between 1 and 10 cm, preferably between 2 and 6 cm, preferably between 3 and 5 cm, such as around 4 cm. The thickness of the strap is preferably less than 10 mm, more preferably less than 5 mm, even more preferably less than 2 mm, most preferably less than 1.2 mm, such as around 1 mm thickness. As an example, an 1.5 inch flat webbing of 0.04 inch thickness can be used, corresponding to a webbing width of 3.8 cm and 1 mm thickness.

Figure 4:
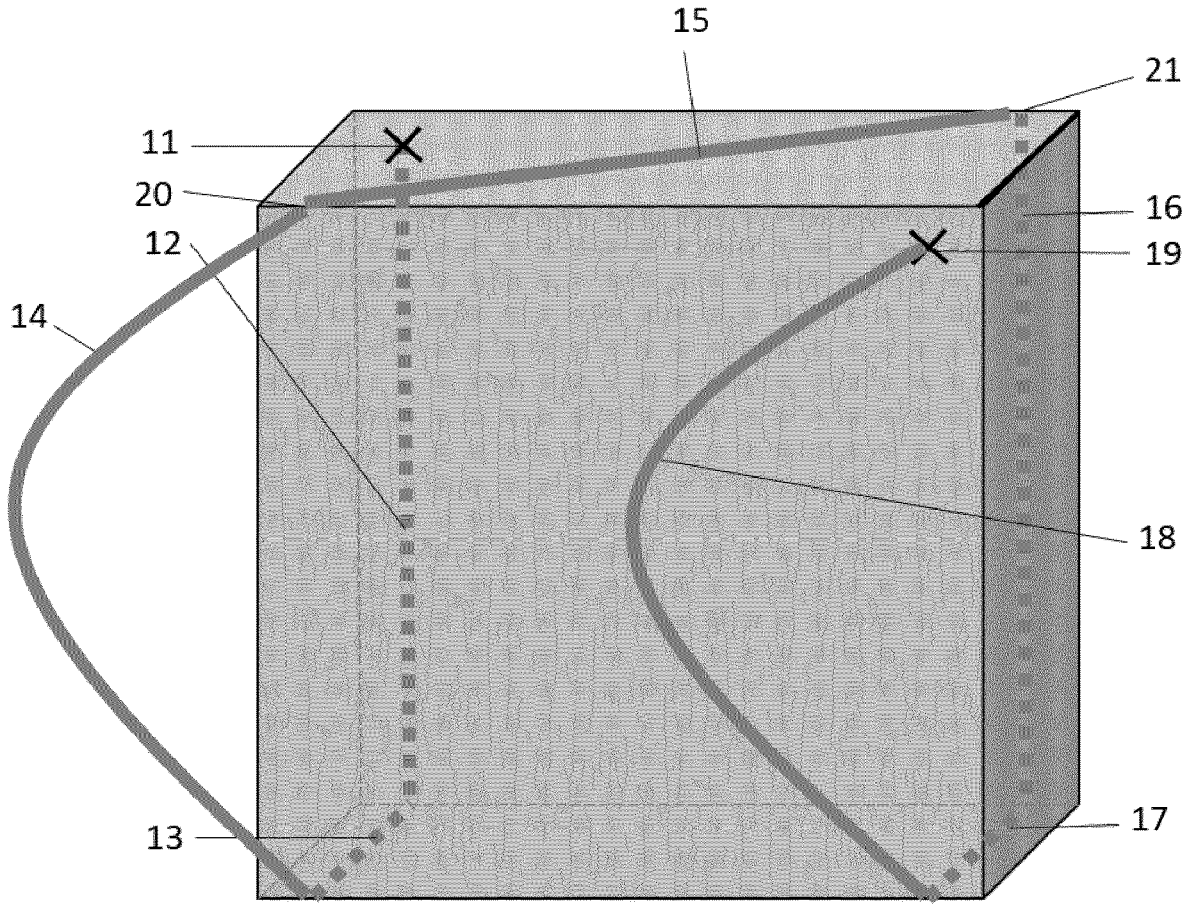
FIG. 4 shows a sketch of one embodiment of the presently disclosed bag in rucksack mode.

In the preferred embodiment the bag is configured such that each of said opposite sides can face the back of a user during rucksack use. This enables the user to lead the strap into rucksack configuration on either of the opposite sides of the bin. This means that the bag can be worn as a rucksack regardless of which side of the two opposite sides is facing the user. The straps can be pulled out and the bag can be worn as a rucksack on either side. This can further increase the speed of which the bag is transformed into a rucksack as the user will not have to turn the bag to the side on which the rucksack transformation is possible, if for example the user by chance should grab the bag on the opposite side. An additional feature of this is the possibility to have different colours or designs on each side of the bag, if one wants to be able to change the look of the rucksack. If for example the strap is encircling the bag in a manner as the one illustrated in FIG. 3, one may pull the sections 14 and 18 and arrive at the rucksack mode as shown in FIG. 4. The purpose of FIG. 3 is to illustrate the overall configuration of the strap in the present example and hence the access strap length necessary to transform the bag from the one shown in FIG. 3 to FIG. 4 is not shown in FIG. 3. The strap would hence have to be longer than shown in FIG. 3, but in order to more clearly illustrate the path of the strap, the strap of FIG. 3 has been shown as tightly encircling the bag. If one wish to transform the bag from the rucksack mode of FIG. 4 into the shoulder bag mode of FIG. 5 they would simply have to pull the diagonal top-part of the strap 15 to make the access strap move from the sections 14 and 18, via the slidable engagements, to section 15 arriving at the configuration shown in illustrated in FIG. 5. Hence, no detachment or reattachment of the strap is required, and the transformation is fast and mind free. Vice versa, the shoulder bag may be transformed into a rucksack by pulling the parts of the strap configured for being in contact with the shoulders during rucksack use. In this example that would be strap sections 14 and 18 or 12 and 16 depending on which side of the bag should face the back of the user. In the rucksack mode strap section 15 may be tightly following the top part of the bin. If the bin opening, such as by a zipper, is situated on this top part, it may further make it more difficult for pickpockets to enter the bag in rucksack mode. If the bag is configured such that each of said opposite sides can face the back of a user during rucksack use, the rucksack mode may be configured so that one of the strap end attachments and three of the slidable engagements on each opposite sides define four carrying positions of a rucksack, such that each of said opposite sides can face the back of a user during rucksack use.

The opposite sides may have a four-cornered shape, the opposite sides may for example be squares or rectangles. The shape and dimensions may be so that it perfectly fit a laptop computer or a compendium of A4 papers. The bag may also have other shapes or dimensions which may depend on the purpose of the specific bag. For example if it is a laptop bag, a bag for luggage or a bag for small personal items.

Figure 5:
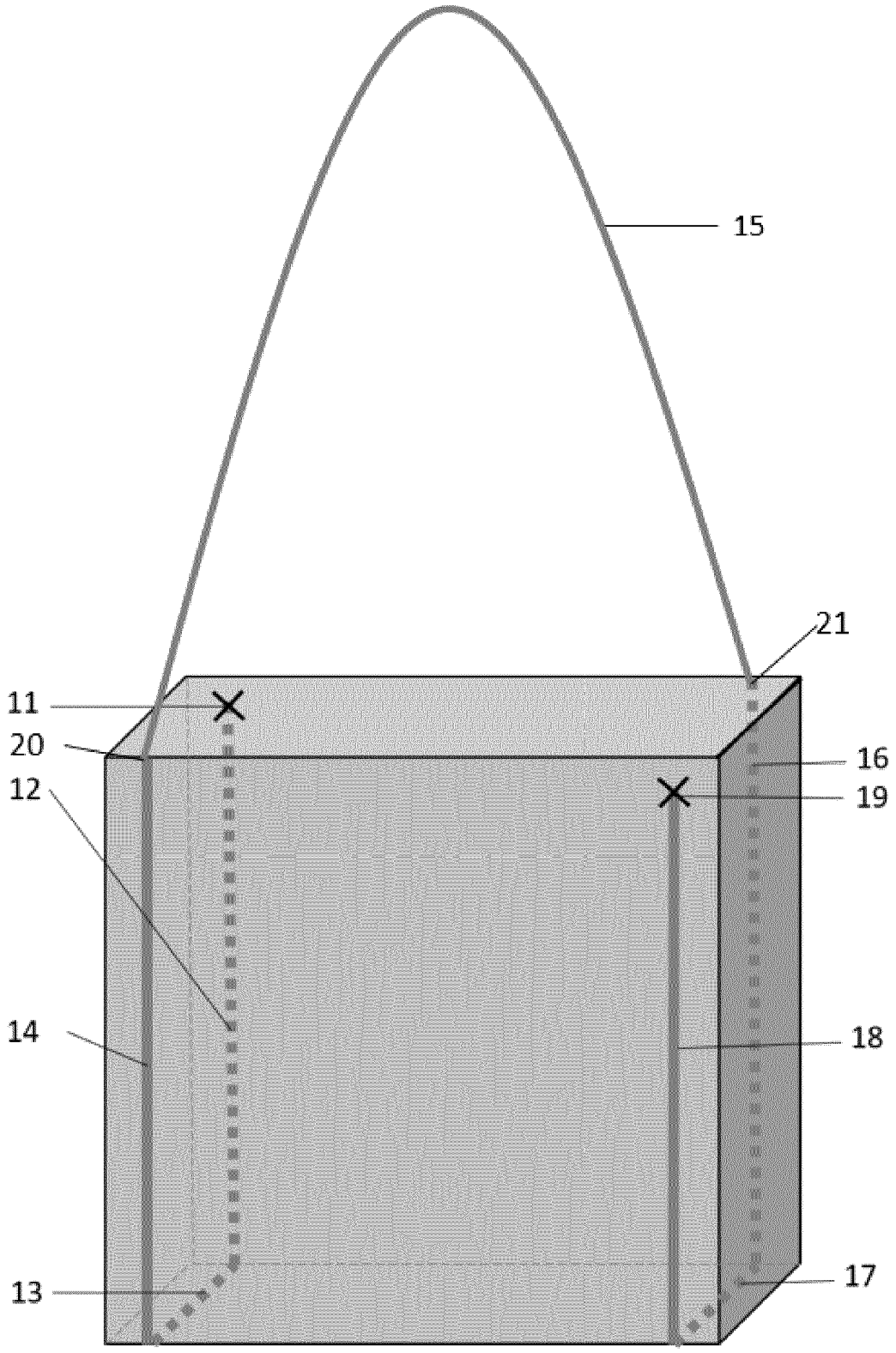
FIG. 5 shows a sketch of one embodiment of the presently disclosed bag in shoulder bag mode.

In one embodiment each strap end attachment and slidable engagement is placed adjacent to a corner of the opposite sides. By placing the strap attachment in the proximity to the corner, as shown at 11 and 19 in FIG. 3-5, the strap can be led through the slidable engagements likewise placed in the proximity to the corners, and the path of the strap will then be close to the edges of the bag as shown in FIGS. 3-5. In this manner, the strap can be at a comfortable position for having the bag in rucksack mode, as illustrated by the two parts of the strap 14 and 18 in FIG. 4. The two parts of the strap 14 and 18 may hence be placed at a distance that suits the distance between the shoulders on an average person. This distance can be smaller if the bag is made for a child. Also if two of the slidable engagement are placed close to the corner in the top part of the two opposite sides of the bag, for example in the positions at or adjacent to 20 and 21 in FIG. 3-5, the slidable engagement will ensure the position at two corner positions on opposite sides of the bin in proper places for the bag to be carried as a shoulder bag. The diagonally positioning of the slidable engagements 20 and 21 further ensures that the bag is lifted in a symmetric manner so that the bag will balance in a harmonic manner, hanging straight downwards. This is an advantage compared to bags in which the carrying points of the shoulder bag mode is on the same side of the bag. In such cases, the bag would tilt slightly forward when lifted, due to the weight of the bag. This will be a less comfortable and may be somewhat odd looking.

The positions 20 and 21 in FIG. 3-5 may be placed on the two opposite sides of the bin, or on the top part of the bin close to the edges between the two opposite sides and top part, or it may be placed on the edges between the opposite sides and the top part of the bin, for example if they are fastened by including the slidable engagements in the hem between the different parts of the bin.

Each strap end attachment may be placed at a diagonal distance to a corner. In this manner, the fixation of the strap may for instance be at the two diagonal corners 11 and 19 opposite to the two diagonal corners having the slidable engagements 20 and 21 as shown in FIG. 3-5. In this embodiment the strap section 15, which can be pulled to become the shoulder bag strap, as shown in FIG. 5, will be placed between the slidable engagements 20 and 21. Hence, the shoulder bag strap will connect the two diagonal corners opposite to the strap end attachments as shown in FIG. 5. Furthermore, all strap end attachments or slidable engagements of the bag may be

- on the two opposite sides of the bin of the bag 1 and 2 in FIG. 3, or
- on any of the other sides of the bin and the top part or the bottom part or
- they may be on the edges between the sides 1 or 2 and the reaming sides or top part of the bin or bottom part of the bin or a mixture of being placed on sides and in edges.

For example, the strap end attachments or the slidable engagements, such as loops through which the strap is put, might be fastened to the bag by being sewed into the stiches also connecting the sides of the bin of the bag. They may be fastened by including the slidable engagements or strap end attachments in the hem between the different parts of the bin, which may be sewed together. In a preferred embodiment, the bag comprises at least four loops. Some of the loops may be provided as bottom loops for being positioned at the bottom section of the bag. A loop may be a separate strap running across the encircling strap, such that the encircling strap is led through each loop. The loops may be fixed to the storage bin, e.g. by stitching. Alternatively, any of the loops may comprise a plate, which is positioned under the fabric of the storage bin (i.e. such that the plate is not visible from the outside), and a top part, e.g. made in a soft material such as a polymer, wherein the top part is configured for receiving the strap. The plate and top part of the loops will together ensure that the loop(s) are fixed to the storage bin, since the two parts are positioned on opposite sides of the bag.

Figure 8:
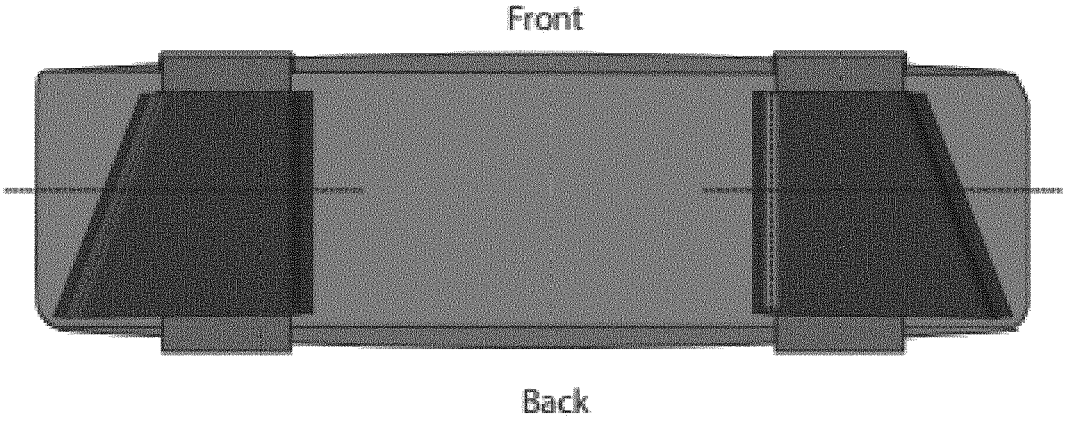
FIG. 8 shows a sketch of one embodiment of the presently disclosed bag, wherein the bag is viewed from below, such that the bottom section is visible.
Figure 9:
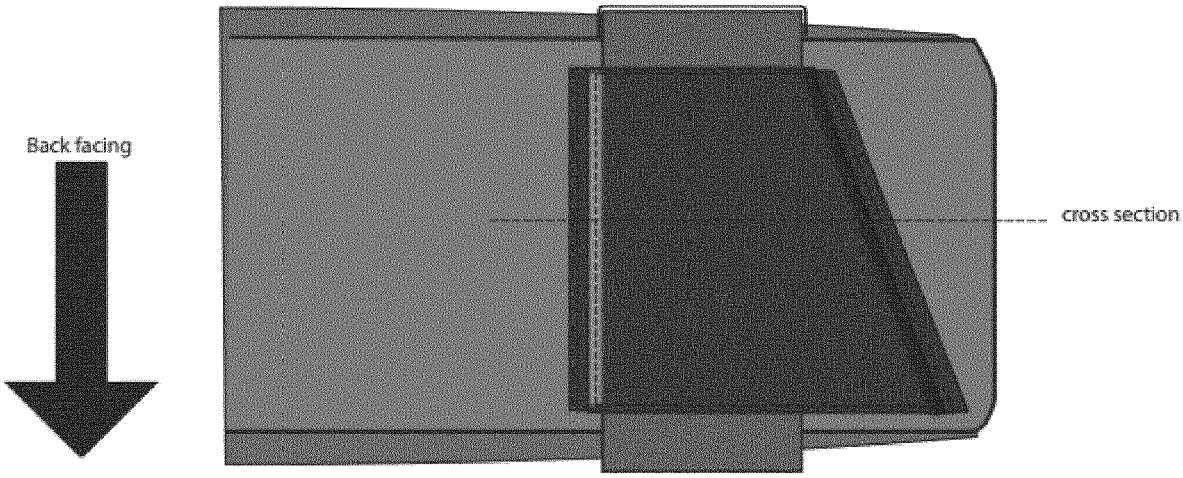
FIG. 9 shows an enlarged section of FIG. 8, wherein one of the loops is visible and the strap is passed through the loop.
Figure 12:
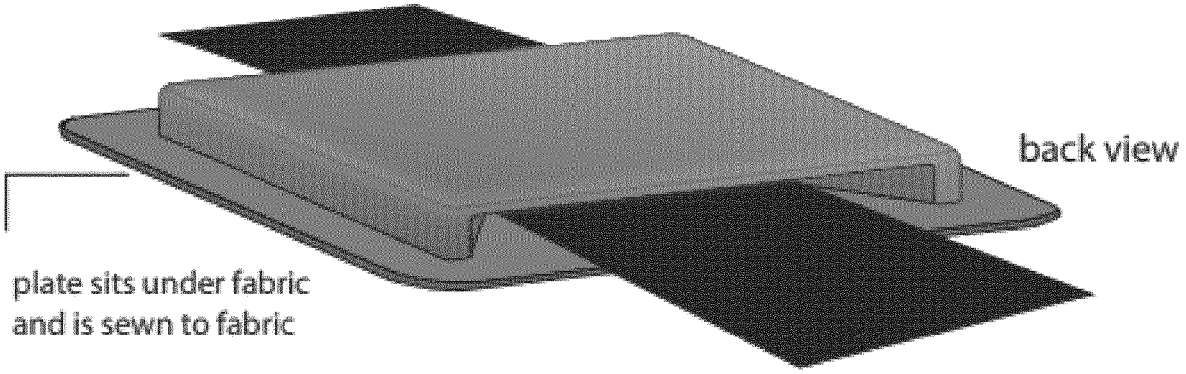
FIG. 12 shows a sketch of an embodiment of a bottom loop for receiving the strap, wherein the bottom loop comprises a plate to be sewn into the fabric of the bag.
Figure 13:
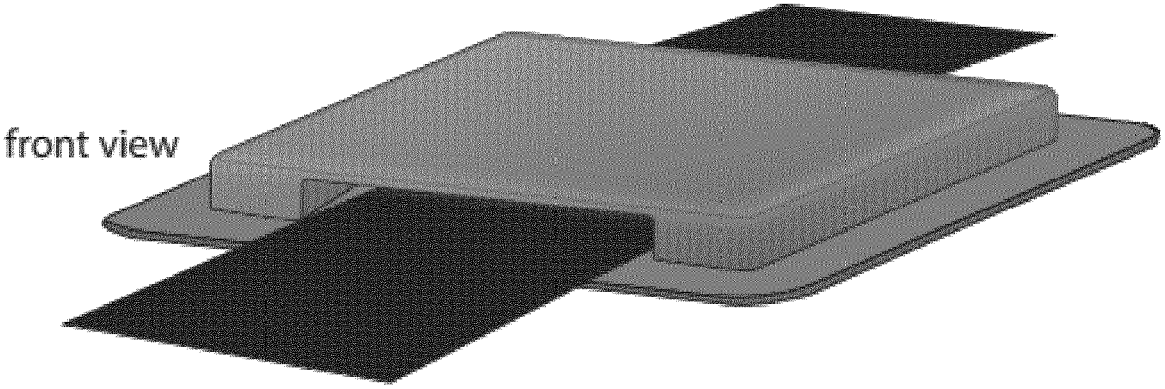
FIG. 13 shows a front view of the bottom loop shown in FIG. 12.

In one embodiment, the bag comprises two bottom loops placed on the bottom section of the bag. The bottom loops have a similar function as the other loops, i.e. the bottom loops comprises an opening for receiving the strap of the bag. Preferably, the bottom loops comprises a first part, which is rigid, and a second part attached to the first part, wherein the second part defines an opening for receiving the strap. The first part may be provided as a plate, such as a plastic plate, which is sewn into the fabric of the bag, such that it is not visible from the outside of the bag. The second part is preferably provided as a top part attached to the plate. The top part may be rigid or flexible. Many materials are suitable for the top part, e.g. polymers or fabric. One embodiment of the bottom loops is shown in FIGS. 12-13. Another embodiment of the bottom loops is shown in FIG. 8. The top part of the bottom loops may also comprise an angled side, such that the strap may exit the top part at an angle (see FIG. 8-9).

Each strap end attachment may be placed along an edge adjacent to a corner. One example of this is shown in FIG. 3-5.

Each strap end attachment may be placed along an upper edge adjacent to a corner. One example of this is shown in FIG. 3-5.

In the preferred embodiment, at least one of the strap end attachments is a fixed bond, such as a glue bond, a thermal bond, or a stitch bond. More preferably, both ends of the strap end attachments are fixed by a fixed bond such as a glue bond, a thermal bond, or a stitch bond. The attachment may be included as a part of the joint of bin sides, for example by including the end attachments in the hem between the different parts of the bin, which may be sewed together. The strap ends could also be included in the glued edge if the edges are glued together, and hereby fastened to the bin. Hence, according to one embodiment of the bag, at least one of the ends of the strap is fixedly attached to the storage bin by stitching, thermal bonding, or by an adhesive.

At least one of the strap end attachments may be configured such that the length of the strap encircling the storage bin can be adjusted. This will allow the user to adjust the length of the strap to have a perfect fit for the user. For instance, users with different height may need different lengths of the strap in order to carry the bag in a comfortable manner in both the shoulder bag configuration and in the rucksack configuration. In the preferred embodiment, at least one of the strap end attachments comprise an adjustable strap belt buckle. Other mechanisms of adjusting the length of the strap may be included. Also a combination of belt buckles and other mechanisms for adjusting the length of the strap may be included. The storage bin of the bag may comprise one or more slits of a size such that the strap can be passed through. In one embodiment, at least one of the ends of the strap is passed through one of the slits, and said end is provided with an adjustable strap belt buckle. The buckle prevents the strap from being pulled through the slit. This arrangement may be an alternative to stitching the end of the strap to the bag, and has the advantage that the length of the strap can be adjusted via the belt buckle.

Each slidable engagement may be placed along an edge adjacent to a corner. Placing the slidable engagements close to a corner may ensure that the strap can be encircling the bag in a manner in which it will not have to ever cross or even be present in the area of the bag touching the back of the user in rucksack mode. This will further increase the comfort for the user carrying the rucksack as no crossing strap is irritating the user while wearing the bag. If in addition the bag is 180 degrees symmetric the strap may be fixated and slidably engaged in a manner in which the strap is not crossing anywhere on either side of the bin which can be used to face the back of the user when in rucksack mode. This is illustrated by one example in FIGS. 3-5. In the preferred embodiment two of the slidable engagements is placed along the upper edge adjacent to the corner.

Figure 6:
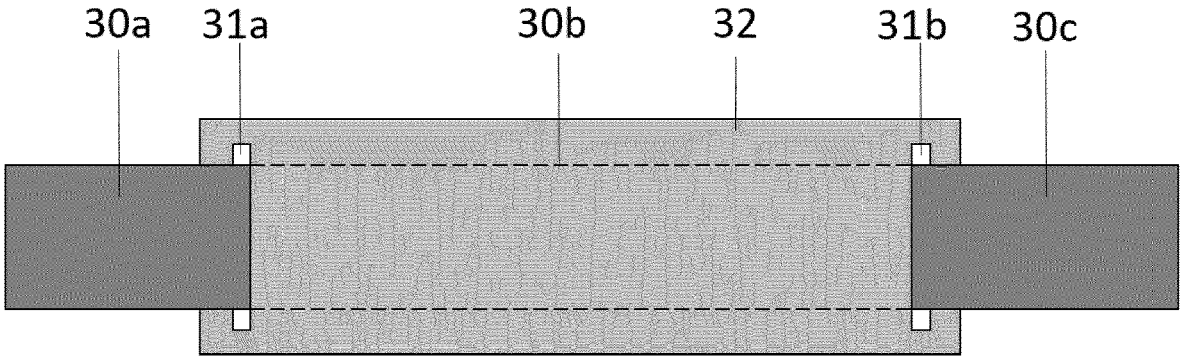
FIG. 6 shows an example of a sleeve used to guide the path of the strap.

In one embodiment the slidable engagements are selected from the group of: metal loops, fabric loops, plastic loops and sleeves. The loops may also be fabricated from any other material. The term sleeves may be interpreted as an elongated patch of fabric or similar attached to the bag surface forming a sleeve-like structure and where the strap is entering the sleeve like structure at one point and passing under the patch and led back up from under the patch at another point. One example of such a sleeve slidable engagement is illustrated in FIG. 6.

In one embodiment, the bag further comprises at least seven or eight slidable engagements with the bin, wherein at least one of the slidable engagements is positioned away from the two opposite sides. These slidable engagements may be used to further guide the path of the strap or to support the strap in any other way for example by providing additional carrying points of the bag.

Figure 7:
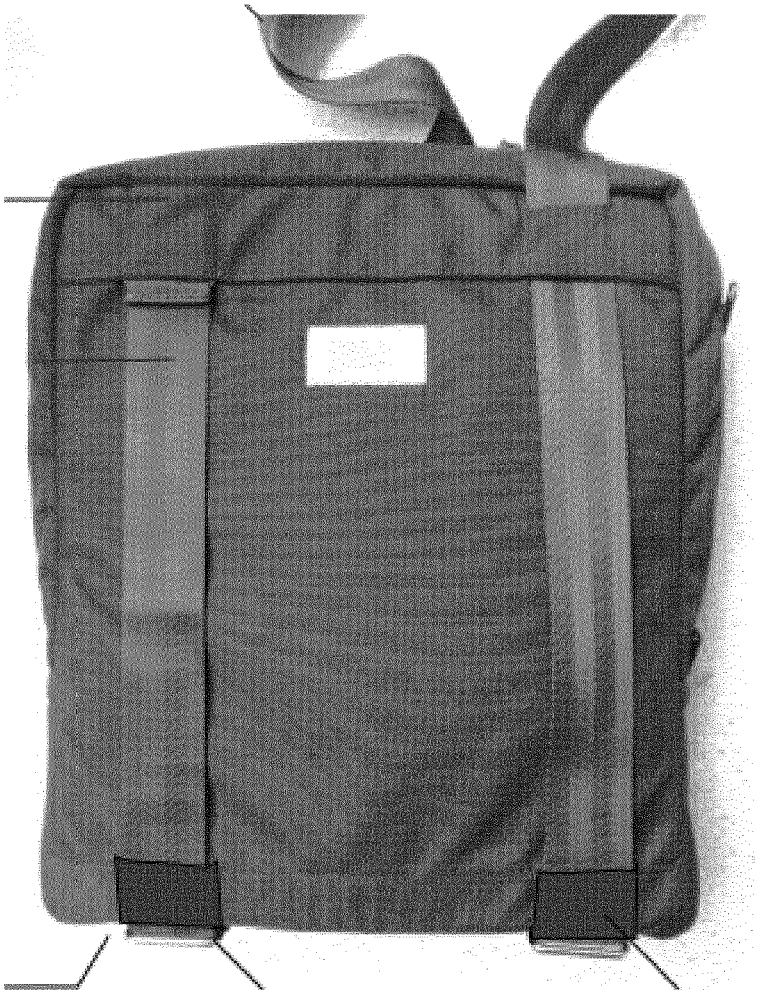
FIG. 7 shows a bag according to one embodiment of the present disclosure.
Figure 10:
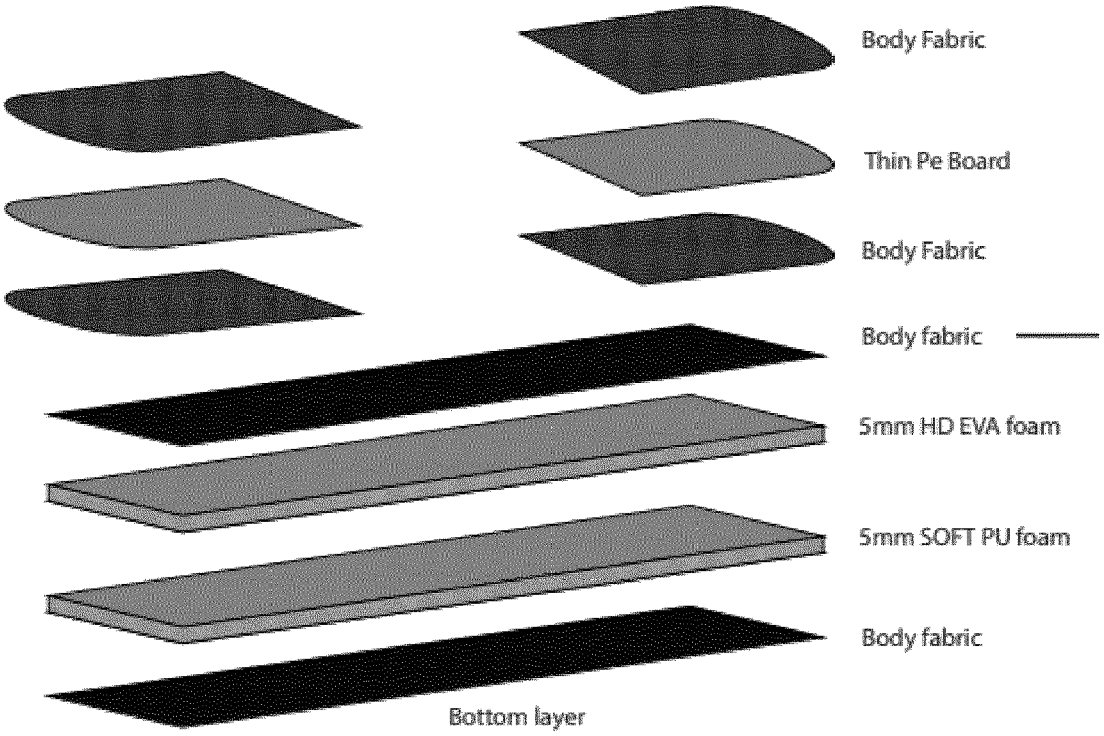
FIG. 10 shows a sketch of an embodiment of a pad for a shoulder strap of the bag.
Figure 11:
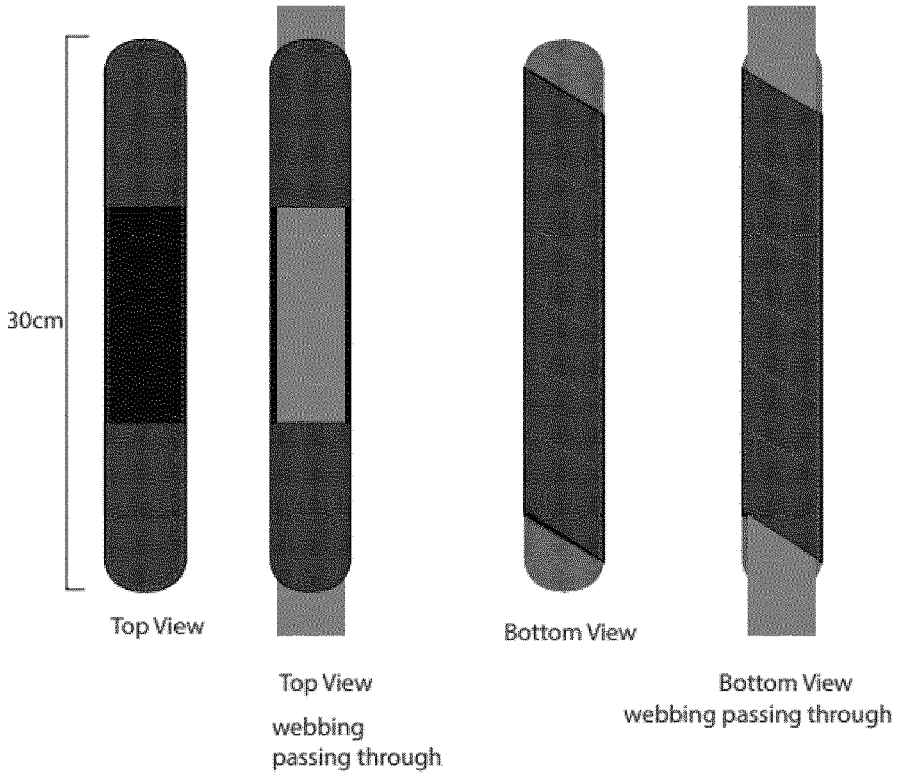
FIG. 11 shows four different views of an embodiment of the pad for the shoulder strap(s)

The strap may comprise one or more pads for increasing the comfort when wearing the bag. In the rucksack configuration of the bag, the continuous strap is preferably pulled such that two shoulder straps are formed (see FIG. 4 or FIG. 7). In one embodiment, each shoulder strap is provided with a pad. The pad(s) may comprise several layers as shown in FIG. 10. The pads preferably comprise one or more foam layers (e.g. EVA foam or soft PU foam), said foam layers ensuring a soft impact when worn. In one embodiment, each shoulder strap is provided with a pad, wherein each pad comprises one or more layers of body fabric, one or more layers of foam, and a thin plastic board (e.g. made in polyethylene).

EXAMPLES

Strap Path

FIG. 3 shows a sketch of one embodiment of the present disclosure in which the path of the single continuous strap is illustrated. The big grey box illustrates the storage bin and the thin dashed lines illustrates the sides and the corner of the storage bin not visible from the given view. The thick lines indicate the path of the strap, and the thick line is dashed in the parts of the strap, which are not visible from the given point of view.

FIG. 3A illustrates the bag seen from the side, viewed from slightly above the bag. The strap is fastened at the cross 11 on the side of the storage bin 1, not visible in the given perspective and led downwards along 12 on the side 1. The strap is then led below the storage bin 13 and up on the other side 2 which is visible in this illustration. The strap is then led along 14 all the way up to the top of side 2 at point 20. From here it is diagonally brought across the top-side along line 15 to reach the opposite corner on side 1 at point 21. From here it is led downwards along 16 and below the storage bin along 17 and back to side 2 where it is led along 18 to the cross 19 marking the position at which it is attached to the bin.

Hence, in FIG. 3A the strap ends are attached to the bin at crosses 11 and 19, which may also be referred to as the strap end attachments, and the path of the strap encircling the storage bin may be divided into seven strap path sections 12-18.

The strap is slidable engaged with the storage bin at strategic places to secure the path of the strap. The strap can hence move through loops or other slidable engagement mechanisms to allow access parts of the strap to be pulled to the area in which it is needed to make the bag into a rucksack or a shoulder bag.

FIG. 3A shows one example of the bag comprising six slidable engagements placed at the intersection between the strap path segments, i.e. between segments 12-13, 13-14, 14-15, 15-16, 16-17, and between segments 17-18. The intersection between 14 and 15 has also been labelled 20 and the intersection between 15 and 16 has also been labelled 21 for the convenience of further descriptions.

FIG. 3B shows a top-view of the bag in which the diagonal path 15 of the strap is clear. The two positions 11+19 in which the strap is attached to the storage bin is again marked and the dashed lines 13+17 indicates the path of the strap below the bag. The sections of the strap following the two sides of the storage bin 1 and 2 which are the strap sections 12, 14, 16 and 18 in FIG. 1A are not visible from this illustrated top-view in FIG. 1B.

Strap Configurations

The strap encircling the storage bin comprises at least one section or part intended for carrying, e.g. a part configured for being in contact with the shoulder during shoulder bag use, or a part configured for being in contact with the shoulder(s) during rucksack use. This part may also be referred to as the access strap.

Figure 1:
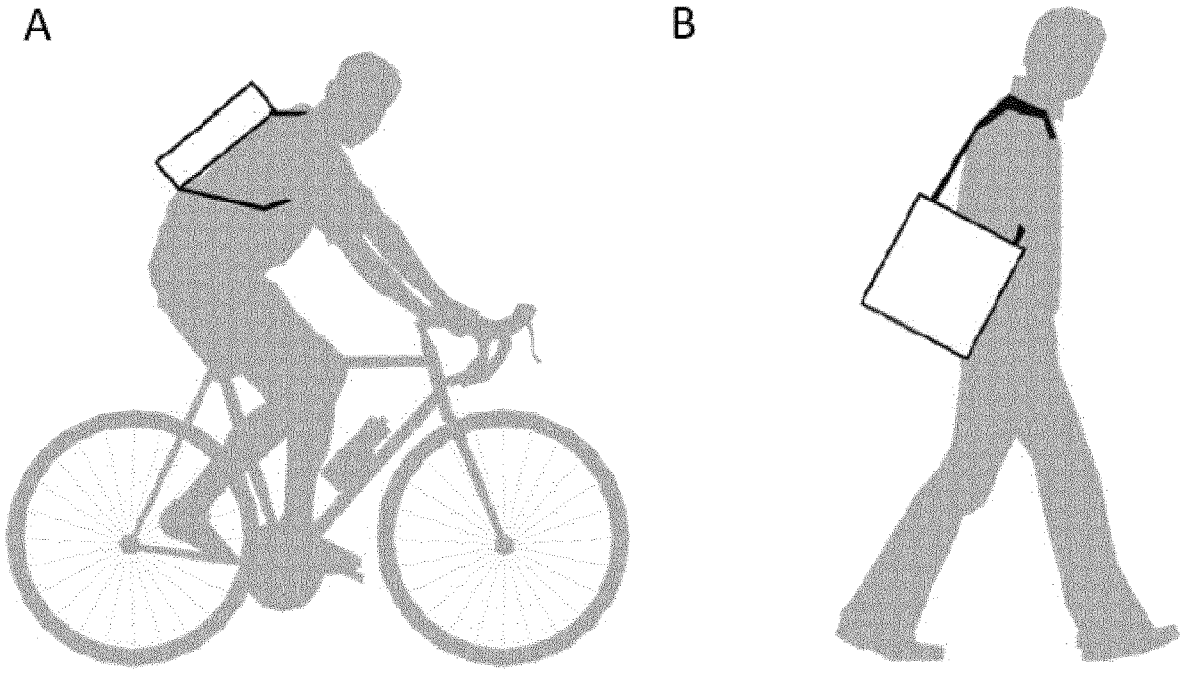
FIG. 1 shows a sketch of one embodiment of the presently disclosed bag worn as a rucksack of a user on a bike (A), and as a shoulder bag worn by the walking user (B)
Figure 2:
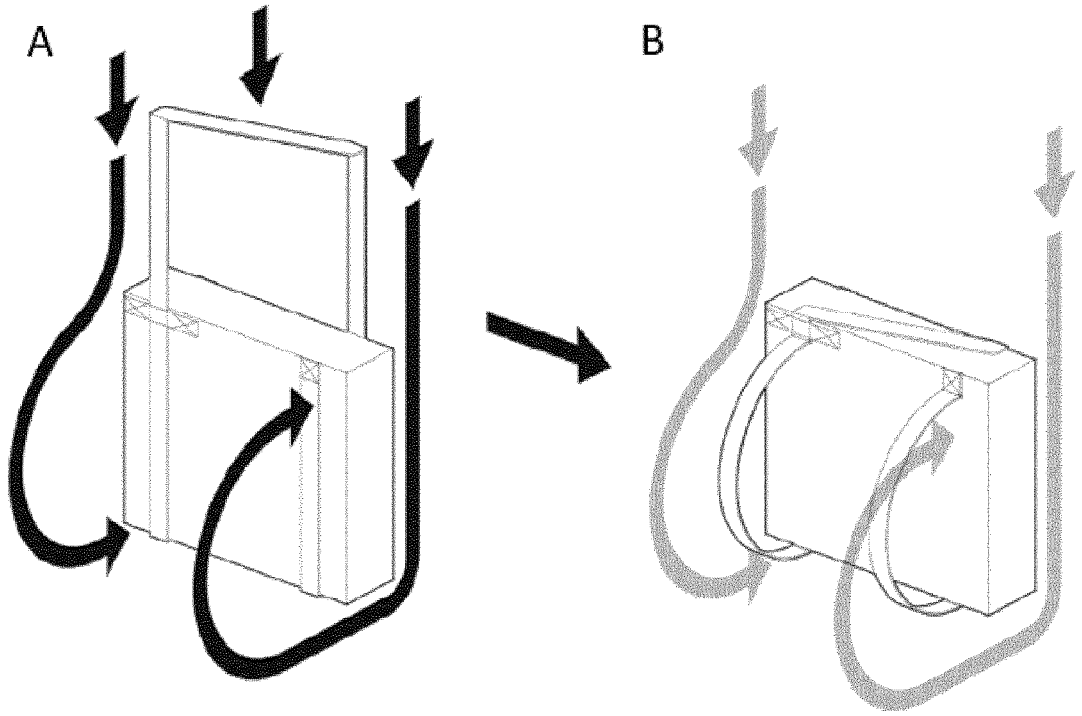
FIG. 2 shows a sketch of one embodiment of the presently disclosed bag illustrating the transformation from shoulder bag (A) to rucksack (B)

FIG. 1 shows a sketch of one embodiment of the present disclosure in which the two different modes of the bag is illustrated, as a rucksack in FIG. 1A or a shoulder bag in FIG. 1B.

The strap may be transformed from the first configuration to the second configuration, and vice versa, by a single, simple movement, as described below.

Rucksack

FIG. 4 shows a sketch of the embodiment of FIG. 3 in which the bag is in rucksack mode. Here the access strap is led to the two parts of the strap passing along side 2, so that the sections 14 and 18 of the strap is now longer so that the user can stick in the arms in each of the formed loops to wear the bag as a rucksack. Since the opposite sides 1, 2 are 180 degrees rotation symmetric, the sections 12 and 16 of the strap may be made longer, so the user can stick the arms in each of the formed loops. Hence, each of the sides 1, 2 can face the back of a user during rucksack use.

Notice that since the bag of FIG. 3 is actually 180 degree symmetric it looks identical regardless of it being viewed from side 1 or side 2.

FIG. 2 shows a sketch of one embodiment of the present disclosure illustrating the transformation from shoulder bag to rucksack. By pulling the strap the access strap length available as a shoulder strap in FIG. 2A can be pulled through the slidable engagements and pulled out at the straps on one of the two sides of the storage bin to form a rucksack as in FIG. 2B.

Alternatively, the shoulder bag may be transformed into a rucksack by simply pulling the parts of the strap configured for being in contact with the shoulders during rucksack use. Hence, by a single, simple movement, comprising pulling the encircling strap at the intended carrying position(s), the bag is transformed.

Shoulder Bag

FIG. 5 shows a sketch of the embodiment of FIG. 3 and FIG. 4 in which the bag is in shoulder bag mode.

The shoulder bag mode can be reached from the rucksack mode of FIG. 4 simply by pulling the strap section 15. This may happen by simply grapping the bag at the strap, in strap section 15, and lift the bag or let it drop towards the floor, in either case gravity will pull the bag downwards while the user pull the bag upwards. Regardless of the nature of the pull it will allow the access strap length previously available in the strap sections 14 and 18 to be released through the slidably engagement of the strap with the bin and result in excess length of the strap to transfer to the strap section 15. This results in the configuration such as the one shown in FIG. 5, which allows the bag to be worn as a shoulder bag.

Hence, by a single, simple movement, comprising pulling the encircling strap at the intended carrying position(s), the bag is transformed

Advantages

For flexible transformation and reduced wear resistance, it is advantageous that both opposite sides of the storage bin can face the back of a user during rucksack use. Thus, it is advantageous that the opposite sides are 180 degrees rotation symmetric, as illustrated in FIG. 3A. The rotation axis is seen to be parallel and centrally placed between the opposite sides.

In an embodiment of the disclosure, the strap end attachments and slidable engagements are distributed such that the opposite sides are 180 degrees rotation symmetric.

To secure the path of the strap in both rucksack configuration and shoulder bag configuration, each strap end attachment and slidable engagement is advantageously placed adjacent to a corner. Specifically, the position of the strap end attachment influences on the stability of the strap path. The strap end attachments may be placed at a diagonal distance to a corner, as illustrated in FIG. 3A, or along an edge adjacent to a corner, such as the upper edge adjacent to the corner, as illustrated in FIG. 2.

The strap end attachment may be formed by any fastening means. Advantageously, the ends are fastened by a fixed bond, such as fastened by glue or stitches. The fastening means may further comprise a length adjuster, such as a strap belt buckle, which can adjust the length of the access strap. Thus, the bag may be flexibly adjusted to be used by different persons having different height and dimensions.

Specifically, the slidable engagements adjacent to the diagonal strap section 15 on the upper side of storage bin, as shown in FIG. 5, are advantageously placed along the upper edge adjacent to the corner, for improved carriage comfort and stability.

The stability of the slidable engagements, and the force needed for transformation of the bag, depend on the materials and shapes. For example, the slidable engagements are advantageously metal loops or fabric loops or sleeves. To further secure the stability of the strap path, the bag advantageously comprises further slidable engagements, preferably where the additional slidable engagements are placed at other sides of the storage bin than the two opposite sides. For example, the bag may comprise additional slidable engagements placed at the lower side of the storage bin.

In an embodiment of the disclosure, the slidable engagements are selected from the group of: metal loops, and fabric loops. In a further embodiment, the bag comprises at least seven or eight slidable engagements with the bin, wherein at least one of the slidable engagements is positioned away from the two opposite sides.

REFERENCE LIST

1—First side of the storage bin
2—Second side of the storage bin
11—First strap end attachment
12—First strap section on first side
13—First strap section on lower side of storage bin
14—First strap section on second side
15—Diagonal strap section on upper side of storage bin
16—Second strap section on first side
17—Second strap section on lower side of storage bin
18—Second strap section on second side
19—Second strap end attachment
30*a*+30*c*—Strap above sleeve
30*b*—Strap part below sleeve
31*a*+31*b*—Hole in patch
32—Patch Items 1. A bag for use as rucksack and shoulder bag, comprising
   a storage bin having two opposite sides, and
   a single continuous strap encircling the storage bin and having
      two strap ends attached at an upper part of said two opposite sides, and
      at least six slidable engagements with the bin at six different positions of said opposite sides,
   wherein the strap ends attachments and slidable engagements are distributed such that the bag has at least two configurations:
   a first configuration wherein one of the strap end attachments and three of the slidable engagements define four carrying positions of a rucksack, and
   a second configuration wherein the strap extends diagonally across a top part of the storage bin between two of said slidable engagements at the opposite sides, and configured for shoulder bag use carrying the bag in the diagonal part of the strap.

2. The bag according to item 1, wherein the strap end attachments and slidable engagements are distributed such that the opposite sides are 180 degrees rotation symmetric.
3. The bag according to any of the preceding items, wherein the bag is configured such that each of said opposite sides can face the back of a user during rucksack use.
4. The bag according to any of the preceding items, wherein the opposite sides have a four-cornered shape such as squares or rectangles.
5. The bag according to items 4, wherein each strap end attachment and slidable engagement is placed adjacent to a corner of the opposite sides.
6. The bag according to any of items 4-5, wherein each strap end attachment is placed at a diagonal distance to a corner.
7. The bag according to any of items 4-6, wherein each strap end attachment is placed along an edge adjacent to a corner.
8. The bag according to item 7, wherein each strap end attachment is placed along an upper edge adjacent to a corner.
9. The bag according to any of the preceding items, wherein at least one of the strap end attachments is a fixed bond, such as a glue bond or stitch bond.
10. The bag according to any of the preceding items, wherein at least one of the strap end attachments are configured to adjust the length of the strap encircling the storage bin.
11. The bag according to item 10, wherein at least one of the strap end attachments comprise an adjustable strap belt buckle.
12. The bag according to any of items 4-11, wherein each slidable engagement is placed along an edge adjacent to a corner.
13. The bag according to item 11, wherein two of the slidable engagements are placed along the upper edge adjacent to the corner.
14. The bag according to any of the preceding items, wherein each slidable engagement is placed along an edge adjacent to a corner of the bag and wherein two of the slidable engagements are placed along the upper edge adjacent to the corner.
15. The bag according to any of the preceding items, wherein the strap is a flat strip in the form of a webbing.
16. The bag according to any of the preceding items, wherein the width of strap is between 3 and 5 cm, such as around 4 cm.
17. The bag according to any of the preceding items, wherein the thickness of the strap is less than 2 mm, such as around 1 mm.
18. The bag according to any of the preceding items, wherein the slidable engagements are selected from the group of: metal loops, fabric loops, plastic loops and sleeves.
19. The bag according to any of the preceding items, further comprising at least seven or eight slidable engagements with the bin, wherein at least one of the slidable engagements is positioned away from the two opposite sides.

The invention claimed is:

1. A bag for use as a rucksack and shoulder bag, comprising:

a storage bin having two opposite sides;

a single continuous strap encircling the storage bin, wherein the ends of the strap are attached to the storage bin on each of the opposite sides at predefined attachment points; and at least four loops attached to the storage bin, wherein the strap is led through each of said loops such that the strap may slide through the loops;

wherein the attachment points and the four loops are distributed such that the bag has at least two configurations:

a first configuration wherein one of the attachment points and three of the loops define carrying points for two shoulder straps such that the bag is configured for use as a rucksack, and a second configuration wherein the strap extends diagonally across a top part of the storage bin between two of the loops located on the opposite sides, wherein the bag may be carried in the strap extending diagonally across the top part, such that the bag is configured for use as a shoulder bag.

2. The bag according to claim 1, wherein each of the opposite sides comprises at least one of the loops.

3. The bag according to claim 1, wherein at least two of the loops are placed along an upper edge of the storage bin.

4. The bag according to claim 1, wherein at least two of the loops are placed on a bottom section of the storage bin.

5. The bag according to claim 1, wherein the predefined attachment points are located at an upper part of the two opposite sides.

6. The bag according to claim 1, wherein the storage bin comprises one or more slits of a size such that the strap can be passed through.

7. The bag according to claim 6, wherein at least one of the ends of the strap is passed through one of the slits, and the strap comprises an adjustable strap belt buckle attached at the end of the strap, wherein the buckle prevents the strap from being pulled through the slit.

8. The bag according to claim 1, wherein at least one of the ends of the strap is fixedly attached to the storage bin by stitching, thermal bonding, or by an adhesive.

9. The bag according to claim 1, wherein both of the ends of the strap are fixedly attached to the storage bin.

10. The bag according to claim 1, wherein the bag comprises at least six loops attached to the storage bin.

11. The bag according to claim 1, wherein the bag is 2-fold rotationally symmetric with respect to a central vertical axis running parallel with the two opposite sides such that any of said opposite sides can face the back of a user in the rucksack configuration.

12. The bag according to claim 1, wherein each of the opposite sides has a four-cornered shape.

13. The bag according to claim 12, wherein each attachment point is placed adjacent to a corner of the opposite sides.

14. The bag according to claim 12, wherein each attachment point is placed at a diagonal distance to a corner.

15. The bag according to claim 12, wherein each attachment point is placed along an edge adjacent to a corner.

16. The bag according to claim 1, wherein the strap is configured such that the length of the strap can be adjusted by means of an adjustable strap belt buckle.

17. The bag according to claim 1, wherein each of the loops is placed along an edge adjacent to a corner.

18. The bag according to claim 1, wherein two of the loops are placed along the upper edge adjacent to the corner.

19. The bag according to claim 1, wherein each loop is placed along an edge adjacent to a corner of the bag and wherein two of the loops are placed along the upper edge adjacent to the corner.

20. The bag according to claim 1, wherein the strap is a flat strip in the form of a webbing.

* * * * *